United States Patent [19]

Morduchowitz et al.

[11] Patent Number: 4,563,254

[45] Date of Patent: Jan. 7, 1986

[54] MEANS AND METHOD FOR THE ELECTROCHEMICAL CARBONYLATION OF NITROBENZENE OR 2-5 DINITROTOLUENE WITH CARBON DIOXIDE TO PROVIDE A PRODUCT

[75] Inventors: Abraham Morduchowitz, Monsey, N.Y.; Anthony F. Sammells, Naperville; Ronald L. Cook, Aurora, both of Ill.

[73] Assignee: Texaco Inc., White Plains, N.Y.

[21] Appl. No.: 699,521

[22] Filed: Feb. 7, 1985

[51] Int. Cl.[4] ..... C25C 3/00

[52] U.S. Cl. ..... 204/59 R

[58] Field of Search ..... 204/59 R

[56] References Cited

U.S. PATENT DOCUMENTS 4,028,201 7/1977 Tyssee ..... 204/59 R 4,133,726 1/1979 Wagenknecht ..... 204/59 R

OTHER PUBLICATIONS

*Organic Electro Chemistry* 2nd Ed. edited by Baizer et al. (1983) Dekker, pp. 295–304.

*Primary Examiner*—John F. Niebling

*Attorney, Agent, or Firm*—Robert A. Kulason; James J. O'Loughlin; Ronald G. Gillespie

[57] ABSTRACT

Apparatus for the carbonylation of nitrobenzene or 2–5 dinitrotoluene with carbon dioxide to provide a product includes a housing which contains an electrolyte solution having a non-aqueous electrolyte containing a supporting electrolyte. A membrane divides the housing into two sections while permitting ions to move between the two sections. Carbon dioxide and nitrobenzene or 2–5 dinitrotoluene are provided to the housing. A d.c. voltage is provided across the electrolyte solution in the two sections of the housing, to cooperate in a reaction of the carbon dioxide, the nitrobenzene or the 2–5 dinitrotoluene and the electrolyte solution to provide a chemical product.

58 Claims, 1 Drawing Figure

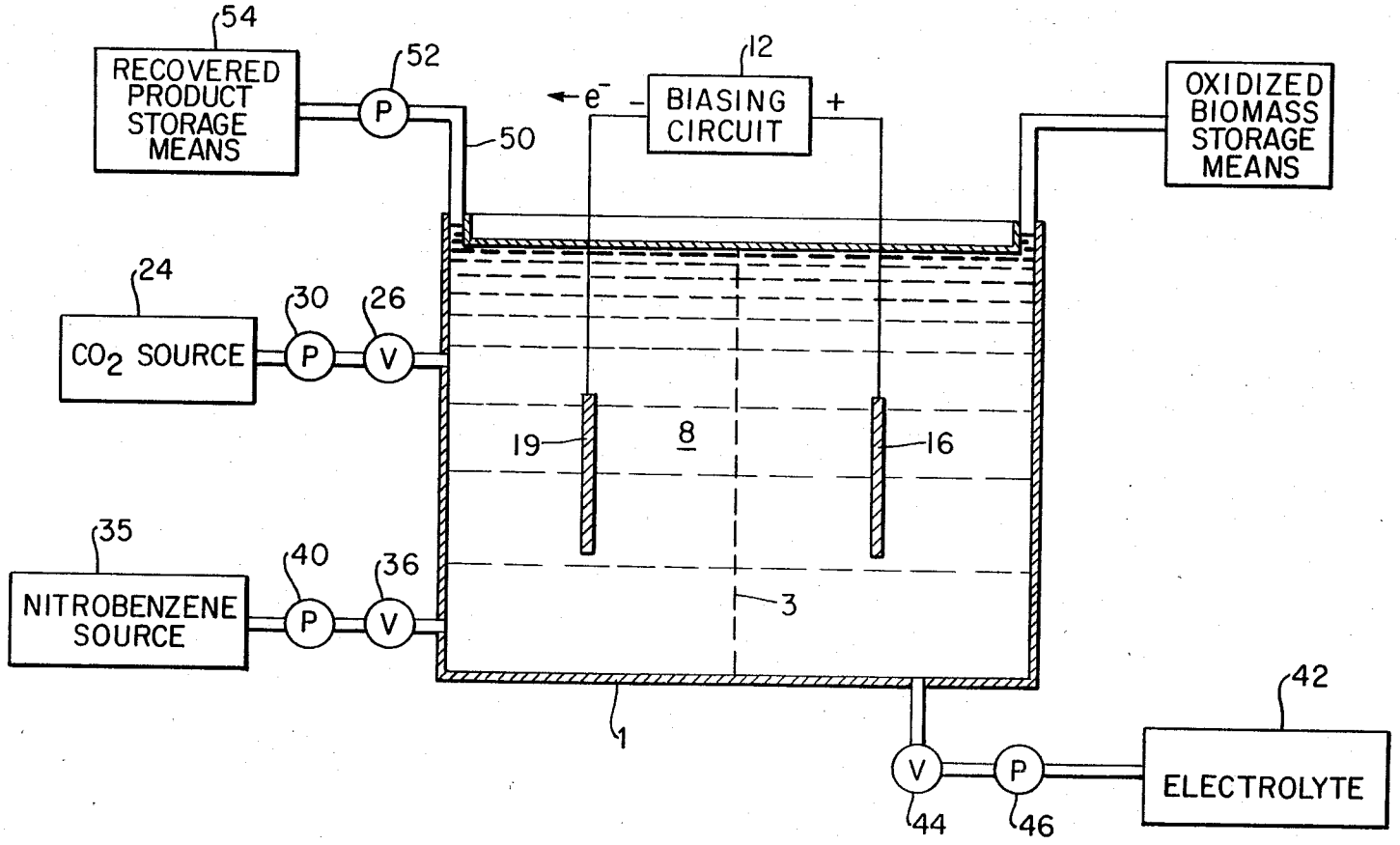
OXIDIZED BIOMASS STORAGE MEANS
ELECTROLYTE
42
46
44
16
3
8
1
12
BIASING CIRCUIT
+
−
e⁻
19
50
52
26
36
30
40
54
RECOVERED PRODUCT STORAGE MEANS
24
CO2 SOURCE
35
NITROBENZENE SOURCE

MEANS AND METHOD FOR THE ELECTROCHEMICAL CARBONYLATION OF NITROBENZENE OR 2-5 DINITROTOLUENE WITH CARBON DIOXIDE TO PROVIDE A PRODUCT

BACKGROUND OF THE INVENTION

Field of the Invention

The present invention relates to apparatus and method for the reduction of carbon dioxide and nitrobenzene to chemicals in general and, more particularly, to electrochemical apparatus and methods.

SUMMARY OF THE INVENTION

Apparatus for the carbonylation of nitrobenzene or 2–5 dinitrotoluene with carbon dioxide to provide a product includes a housing which contains an electrolyte solution having a non-aqueous electrolyte containing a supporting electrolyte. A membrane divides the housing into two sections while permitting ions to move between the two sections. Carbon dioxide and nitrobenzene or 2–5 dinitrotoluene are provided to the housing. A d.c. voltage is provided across the electrolyte solution in the two sections of the housing, to cooperate in a reaction of the carbon dioxide, the nitrobenzene or the 2–5 dinitrotoluene and the electrolyte solution to provide a chemical product.

The objects and advantages of the invention will appear more fully hereinafter, from a consideration of the detailed description which follows, taking together the accompanying drawing, when one embodiment is associated by way of example. It is to be expressly understood, however, that the drawing is for illustrative purposes only, and it is not to be construed as defining the limits of the invention.

DESCRIPTION OF THE DRAWING

The drawing is in partial block diagram form and partial mechanical drawing form shows apparatus, constructed in accordance with the present invention, for the carbonylation of nitrobenzene with carbon dioxide to provide a product.

DESCRIPTION OF A PREFERRED EMBODIMENT OF THE INVENTION

Referring to the Figure, there is shown a housing 1 made of suitable material to contain an electrolyte solution having a non-ionic specific membrane 3. The membrane 3 will pass ions. Contained within housing 1 is a biomass electrolyte solution including a non-aqueous electrolyte selected from the following: dimethylformamide, dichloromethane, acetonitrile, propylene carbonate and dimethyl sulfoxide; and a supporting electrolyte selected from the following: tetrabutylammonium perchlorate, tetrabutylammonium tetrafluoroborate, tetrabutylammonium hexafluorophosphate, tetraethylammonium perchlorate and tetraethylammonium tetrafluoroborate.

A biasing circuit 12 has a positive terminal connected to an anode 16 and a negative terminal connected to a cathode 19. Anode 16 may be made of carbonaceous material or an electrical conductive metallic oxide. Cathode 19 may be made from glassy carbon, platinized platinum, or copper. A source 24 provides carbon dioxide through a valve 26, using a pump 30, to housing 1. Another source 35 provides nitrobenzene by way of a valve 36 and pump 40 to housing 1. A source 42 provides the biomass electrolyte solution to housing 1 through a valve 44 aided by a pump 46.

The electrochemical arrangement hereinbefore described provides for the reductive carbonylation of the nitrobenzene to provide the product nitrobenzoic acid and an isocyanate. The overall reactions occurring are summarized as follows: for nitrobenzoic acid

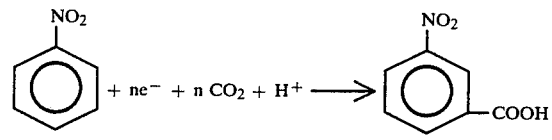

and for isocyanate

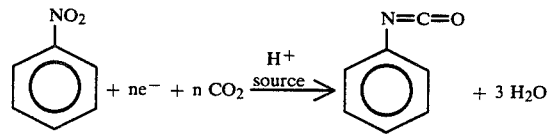

The oxidized biomass electrolyte is stored in storage means 48 for further processing, use or disposal.

The product resulting from the reactions is removed by way of line 50 as a slurry or liquid with the aid of a pump 52 and is stored in a suitable storage means 54.

Within the limitations of the apparatus and method of the present invention faradaic efficiencies between 50 and 100% may be obtained.

In one example the nonaqueous electrolyte was dimethylformamide containing 0.1M of tetrabutylammonium hexafluorophosphate with cathode 19 being made of copper at a potential 1.6 volt negative of the saturated calomel reference electrode at a current density of 4 mA/cm$^2$. It should be noted, for the geometrically smooth electrode used this was a relatively high current density. For porous electrodes significantly higher geometric current densities can be realized.

Although the present invention has been shown for providing nitrobenzoic acid or isocyanate, the carbonylation of 2–5 dinitrotoluene instead of nitrobenzene will yield the principal product of toluene diisocyanate with side products of 1 nitro-4 methylphenyl isocyanate as can be seen in the following diagram.

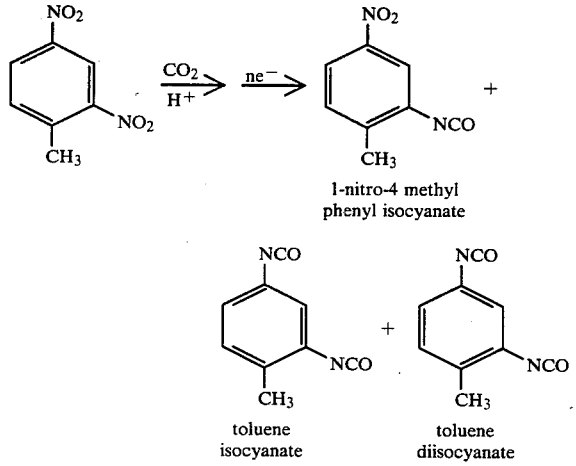

The present invention as herebefore described discloses means and method for the electrochemical carbonylation of nitrobenzene with carbon dioxide to form phenylisocyanate and nitrobenzoic acid in a nonaqueous solvent.

What is claimed is:

1. A method for the carbonylation of nitrobenzene to provide a product comprising the steps of:

providing a biomass electrolyte solution including a non-aqueous electrolyte with a supporting electrolyte, dividing the electrolyte solution into two portions a first and second portion with a non-ionic specific membrane, providing carbon dioxide to the first portion of the electrolyte solution, providing nitrobenzene to the first portion of electrolyte solution, providing a direct current voltage across the two portions of the electrolyte solutions so as to cooperate in a reaction between the carbon dioxide, and nitrobenzene in the electrolyte solution to provide a product, and removing the product from the second portion of the electrolyte solution.

2. A method as described in claim 1 in which the non-aqueous electrolyte is selected from a group of non-aqueous electrolytes: dimethylformamide, dichloromethane, acetonitrile, propylene carbonate and dimethyl sulfoxide.

3. A method as described in claim 2 in which the supporting electrolyte is selected from a group of the following supporting electrolytes: tetrabutylammonium perchlorate, tetrabutylammonium tetrafluoroborate, tetrabutylammonium hexafluorophosphate, tetraethylammonium perchlorate and tetraethylammonium tetrafluoroborate.

4. A method as described in claim 1 in which the non-aqueous electrolyte is dimethylformamide and the supporting electrolyte is tetrabutylammonium perchlorate.

5. A method as described in claim 1 in which the non-aqueous electrolyte is dimethylformamide and the supporting electrolyte is tetrabutylammonium tetrafluoroborate.

6. A method as described in claim 1 in which the supporting electrolyte is dimethylformamide and the supporting electrolyte is tetrabutylammonium hexafluorophosphate.

7. A method as described in claim 1 in which the non-aqueous electrolyte is dimethylformamide and the supporting electrolyte is tetraethylammonium perchlorate.

8. A method as described in claim 1 in which the non-aqueous electrolyte is dimethylformamide and the supporting electrolyte is tetraethylammonium tetrafluoroborate.

9. A method as described in claim 1 in which the non-aqueous electrolyte is dichloromethane and the supporting electrolyte is tetrabutylammonium perchlorate.

10. A method as described in claim 1 in which the non-aqueous electrolyte is dichloromethane and the supporting electrolyte is tetrabutylammonium tetrafluoroborate.

11. A method as described in claim 1 in which the non-aqueous electrolyte is dichloromethane and the supporting electrolyte is tetrabutylammonium hexafluorophosphate.

12. A method as described in claim 1 in which the non-aqueous electrolyte is dichloromethane and the supporting electrolyte is tetraethylammonium perchlorate.

13. A method as described in claim 1 in which the non-aqueous electrolyte is dichloromethane and the supporting electrolyte is tetraethylammonium tetrafluoroborate.

14. A method as described in claim 1 in which the non-aqueous electrolyte is acetonitrile and the supporting electrolyte is tetrabutylammonium perchlorate.

15. A method as described in claim 1 in which the non-aqueous electrolyte is acetonitrile and the supporting electrolyte is tetrabutylammonium hexafluorophosphate.

16. A method as described in claim 1 in which the non-aqueous electrolyte is acetonitrile and the supporting electrolyte is tetraethylammonium perchlorate.

17. A method as described in claim 1 in which the non-aqueous electrolyte is acetonitrile and the supporting electrolyte is tetraethylammonium tetrafluoroborate.

18. A method as described in claim 1 in which the non-aqueous electrolyte is propylene carbonate and the supporting electrolyte is tetrabutylammonium perchlorate.

19. A method as described in claim 1 in which the non-aqueous electrolyte is propylene carbonate and the supporting electrolyte is tetrabutylammonium tetrafluoroborate.

20. A method as described in claim 1 in which the non-aqueous electrolyte is propylene carbonate and the supporting electrolyte is tetrabutylammonium hexafluorophosphate.

21. A method as described in claim 1 in which the non-aqueous electrolyte is propylene carbonate and the supporting electrolyte is tetraethylammonium perchlorate.

22. A method as described in claim 1 in which the non-aqueous electrolyte is propylene carbonate and the supporting electrolyte is tetraethylammonium tetrafluoroborate.

23. A method as described in claim 1 in which the non-aqueous electrolyte is dimethyl sulfoxide and the supporting electrolyte is tetrabutylammonium perchlorate.

24. A method as described in claim 1 in which the non-aqueous electrolyte is dimethyl sulfoxide and the supporting electrolyte is tetrabutylammonium tetrafluoroborate.

25. A method as described in claim 1 in which the non-aqueous electrolyte is dimethyl sulfoxide and the supporting electrolyte is tetrabutylammonium hexafluorophosphate.

26. A method as described in claim 1 in which the non-aqueous electrolyte is dimethyl sulfoxide and the supporting electrolyte is tetraethylammonium perchlorate.

27. A method as described in claim 1 in which the non-aqueous electrolyte is dimethyl sulfoxide and the supporting electrolyte is tetraethylammonium tetrafluoroborate.

28. A method as described in claim 1 in which the product includes an isocyanate.

29. A method as described in claim 1 in which the product further includes nitrobenzoic acid.

30. A method for the carbonylation of 2–5 dinitrotoluene to provide a product comprising the steps of:

providing an electrolyte solution including a non-aqueous electrolyte with a supporting electrolyte, dividing the electrolyte solution into two portions a first and a second portion with a non-ionic specific membrane, providing carbon dioxide to the first portion of the electrolyte solution, providing 2–5 dinitrotoluene to the first portion of electrolyte solution, providing a direct current voltage across the two portions of the electrolyte solutions so as to cooperate in a reaction between the carbon dioxide, and 2–5 dinitrotoluene in the electrolyte solution to provide a product, and removing the product from the second portion of the electrolyte solution.

31. A method as described in claim 30 in which the non-aqueous electrolyte is selected from a group of non-aqueous electrolytes: dimethylformamide, dichloromethane, acetonitrile, propylene carbonate and dimethyl sulfoxide.

32. A method as described in claim 31 in which the supporting electrolyte is selected from a group of the following supporting electrolytes: tetrabutylammonium perchlorate, tetrabutylammonium tetrafluoroborate, tetrabutylammonium hexafluorophosphate, tetraethylammonium perchlorate and tetraethylammonium tetrafluoroborate.

33. A method as described in claim 30 in which the non-aqueous electrolyte is dimethylformamide and the supporting electrolyte is tetrabutylammonium perchlorate.

34. A method as described in claim 30 in which the non-aqueous electrolyte is dimethylformamide and the supporting electrolyte is tetrabutylammonium tetrafluoroborate.

35. A method as described in claim 30 in which the supporting electrolyte is dimethylformamide and the supporting electrolyte is tetrabutylammonium hexafluorophosphate.

36. A method as described in claim 30 in which the non-aqueous electrolyte is dimethylformamide and the supporting electrolyte is tetraethylammonium perchlorate.

37. A method as described in claim 30 in which the non-aqueous electrolyte is dimethylformamide and the supporting electrolyte is tetraethylammonium tetrafluoroborate.

38. A method as described in claim 30 in which the non-aqueous electrolyte is dichloromethane and the supporting electrolyte is tetrabutylammonium perchlorate.

39. A method as described in claim 30 in which the non-aqueous electrolyte is dichloromethane and the supporting electrolyte is tetrabutylammonium tetrafluoroborate.

40. A method as described in claim 30 in which the non-aqueous electrolyte is dichloromethane and the supporting electrolyte is tetrabutylammonium hexafluorophosphate.

41. A method as described in claim 30 in which the non-aqueous electrolyte is dichloromethane and the supporting electrolyte is tetraethylammonium perchlorate.

42. A method as described in claim 30 in which the non-aqueous electrolyte is dichloromethane and the supporting electrolyte is tetraethylammonium tetrafluoroborate.

43. A method as described in claim 30 in which the non-aqueous electrolyte is acetonitrile and the supporting electrolyte is tetrabutylammonium perchlorate.

44. A method as described in claim 30 in which the non-aqueous electrolyte is acetonitrile and the supporting electrolyte is tetrabutylammonium hexafluorophosphate.

45. A method as described in claim 30 in which the non-aqueous electrolyte is acetonitrile and the supporting electrolyte is tetraethylammonium perchlorate.

46. A method as described in claim 30 in which the non-aqueous electrolyte is acetonitrile and the supporting electrolyte is tetraethylammonium tetrafluoroborate.

47. A method as described in claim 30 in which the non-aqueous electrolyte is propylene carbonate and the supporting electrolyte is tetrabutylammonium perchlorate.

48. A method as described in claim 30 in which the non-aqueous electrolyte is propylene carbonate and the supporting electrolyte is tetrabutylammonium tetrafluoroborate.

49. A method as described in claim 30 in which the non-aqueous electrolyte is propylene carbonate and the supporting electrolyte is tetrabutylammonium hexafluorophosphate.

50. A method as described in claim 30 in which the non-aqueous electrolyte is propylene carbonate and the supporting electrolyte is tetraethylammonium perchlorate.

51. A method as described in claim 30 in which the non-aqueous electrolyte is propylene carbonate and the supporting electrolyte is tetraethylammonium tetrafluoroborate.

52. A method as described in claim 30 in which the non-aqueous electrolyte is dimethyl sulfoxide and the supporting electrolyte is tetrabutylammonium perchlorate.

53. A method as described in claim 30 in which the non-aqueous electrolyte is dimethyl sulfoxide and the supporting electrolyte is tetrabutylammonium tetrafluoroborate.

54. A method as described in claim 30 in which the non-aqueous electrolyte is dimethyl sulfoxide and the supporting electrolyte is tetrabutylammonium hexafluorophosphate.

55. A method as described in claim 30 in which the non-aqueous electrolyte is dimethyl sulfoxide and the supporting electrolyte is tetraethylammonium perchlorate.

56. A method as described in claim 30 in which the non-aqueous electrolyte is dimethyl sulfoxide and the supporting electrolyte is tetraethylammonium tetrafluoroborate.

57. A method as described in claim 30 in which the product is toluene diisocyanate.

58. A method as described in claim 1 which further includes a side product of toluene diisocyanate.

* * * * *